United States Patent [19]

Webster, III

[11] 4,398,977

[45] Aug. 16, 1983

[54] SIMULTANEOUS RED SMOKE AND BRIGHT FLAME COMPOSITION CONTAINING AMMONIUM IODATE

[75] Inventor: Henry A. Webster, III, Ellettsville, Ind.

[73] Assignee: The United States of America as represented by the Secretary of the Navy, Washington, D.C.

[21] Appl. No.: 405,648

[22] Filed: Aug. 5, 1982

[51] Int. Cl.[3] ..... C06B 33/06

[52] U.S. Cl. ..... 149/42; 149/75

[58] Field of Search ..... 149/42, 75, 117

[56] References Cited

U.S. PATENT DOCUMENTS

| | | | |
|---|---|---|---|
| 1,318,074 | 10/1919 | Gowdy . | |
| 2,995,526 | 8/1961 | DeMent | 252/305 |
| 3,046,168 | 7/1962 | Burkardt et al. | 149/42 |
| 3,133,841 | 5/1964 | Kuehl | 149/5 |
| 3,255,058 | 6/1966 | Wyman et al. | 149/2 |
| 3,274,035 | 9/1966 | Burkardt et al. | 149/42 |
| 3,383,860 | 5/1968 | Sayles | 60/218 |
| 3,664,898 | 5/1972 | Taylor et al. | 149/41 |
| 3,695,951 | 10/1972 | Helms et al. | 149/19 |
| 3,725,156 | 4/1973 | Thompson | 149/81 |
| 3,726,730 | 4/1973 | Rose et al. | 149/42 |
| 4,166,045 | 8/1979 | Rudy | 252/414 |
| 4,184,901 | 1/1980 | Tanner, Jr. et al. | 149/19.6 |
| 4,238,254 | 12/1980 | Prahauser et al. | 149/29 |

*Primary Examiner*—Edward A. Miller

*Attorney, Agent, or Firm*—Robert F. Beers; Paul S. Colignon

[57] ABSTRACT

A pyrotechnic composition is formulated which, when burned, produces red smoke and bright flame. The composition is comprised of between 25 and 65 percent of ammonium iodate, between 30 and 45 percent of iodoform, between 0 and 5 percent of diatomaceous earth and the balance of a fuel selected from a group consisting of bismuth, molybdenum, and a mixture of bismuth and magnesium.

8 Claims, No Drawings

SIMULTANEOUS RED SMOKE AND BRIGHT FLAME COMPOSITION CONTAINING AMMONIUM IODATE

BACKGROUND OF THE INVENTION

The present invention relates to a composition which, when burned, will produce both red smoke and bright flame.

The basic use of colored displays is for communication and colored signals are used to indicate conditions of distress, identification, recognition and warning. Color signals are also used as markers to indicate the position of opposing elements for purposes of acquisition and attack. The basic requirement for a colored display is that it must provide a highly visible, unambiguous, easily identifiable mark.

Colored displays generally take the form of colored flares for night signaling and colored smokes for day signaling. Many devices provide only the single signal, that is, it will produce either smoke or flame, but not both, thus it is frequently necessary to carry both smoke signals or flare signals.

In order to eliminate the necessity of carrying two types of signals, some signals are made that serve a dual function. In one type of signal, a smoke signal is provided on one end and a flare signal is provided on the opposite end. One such device is shown in U.S. Pat. No. 3,908,550, entitled "One Hand Operable Distress Signal," which issued Sept. 30, 1975, to Bobby D. Beatty et al. In this distress signal a container is provided which has a smoke-producing composition in one end and a flare composition in the other end. Each pyrotechnic composition is contained in a separate inner container which in turn are housed in a telescoping fashion in each end of an outer container. A spring is provided for extending each inner container and a locking lever is provided for retaining the inner container inside the outer container. Once the inner container is extended, a manual firing lever is accessible for actuating a firing pin which detonates a primer and, in turn, ignites a pyrotechnic material.

One disadvantage to devices which provide both a smoke signal and a flare signal is that the time of display for each signal is relatively short in order to provide for both displays and normally the unit is lost or discarded after burning one end. Also these devices are relatively expensive as dual hardware is used on both ends.

In order to eliminate dual hardware, some dual units are made which are designed to burn first a smoke composition followed by a flare. Obviously, of course, the shorter display time is still present. An additional disadvantage with this signal is one of producing a good flare color. In operation, these signals first burn the smoke composition and a solid carbonaceous clinker remains after the burning reaction. When the flare composition is ignited, the flame must burn through the center of this clinker and the color of the flame can be severely degraded.

In U.S. Pat. No. 4,184,901, which issued Jan. 22, 1980, to John E. Tanner, Jr. and Henry A. Webster III, there is disclosed a composition for simultaneously producing, when burned, yellow smoke and yellow flame. The composition is comprised of between 5 and 30 percent of a fuel which is either magnesium or silicon, between 65 and 85 percent of bismuth subnitrate and between 5 and 13 percent of an epoxy binder.

SUMMARY OF THE INVENTION

The present invention relates to a pyrotechnic composition which, when burned, will produce both red smoke and a bright flame. The red smoke produced is primarily intended for communication and, by way of example, might indicate conditions of distress, identification, recognition and warning. The bright flame which is produced can also serve the same function at night.

The present invention relates to a pyrotechnic composition which is comprised of between 25 and 65 percent of ammonium iodate, between 30 and 45 percent of iodoform, between 0 and 5 percent of diatomaceous earth and between 20 and 40 percent of a fuel. The fuel is either bismuth, molybdenum, or a mixture of bismuth and magnesium.

It is therefore a general object of the present invention to provide a pyrotechnic composition which, when burned in daylight, will produce red smoke which can be used for communication purposes and which, when burned at night, will produce a bright flame.

Other objects and advantages of the present invention will be readily appreciated as the same becomes better understood by reference to the following detailed description.

DESCRIPTION OF THE PREFERRED EMBODIMENT

The red smoke/bright flame compositions of the present invention are comprised essentially of between 25 and 65 percent of ammonium iodate, between 30 and 45 percent of iodoform and between 20 and 40 percent of a fuel. The fuel is either bismuth, molybdenum, or a mixture of bismuth and magnesium. The colored displays produced by burning the compositions of the present invention can be used as signals to indicate conditions of distress, identification, recognition and warning. Also, candles made of the composition of the present invention can be used as markers to indicate the position of opposing elements for purpose of acquisition and attack or to indicate fuze-action and the functional accuracy of weapons.

The following examples will illustrate the preferred embodiments of the invention wherein parts and percentages are by weight unless otherise specified.

EXAMPLE 1

| | Percent |
|---|---|
| Bismuth | 40 |
| Iodoform | 35 |
| Ammonium Iodate | 25 |

The ingredients were mixed and one hundred grams of the composition were pressed into a 3.3 cm ID fishpaper tube. The candle was pressed at 7500 psi. The length of the candle was 5.1 cm. Approximately 20 grams of fireclay were pressed on one end of the candle and about 10 grams of ignition composition were pressed on the other end. The candle was burned outdoors, face-up, in a relatively static environment. The candle was burned with the following results:

| | |
|---|---|
| Burn rate | 0.169 cm/s |
| Smoke volume | Excellent |
| Smoke color | Reddish brown |

-continued

| | |
|---|---|
| Flame color | Bright yellowish-white |

EXAMPLE 2

| | |
|---|---|
| Bismuth | 40 |
| Iodoform | 30 |
| Ammonium Iodate | 25 |
| Diatomaceous earth | 5 |

The ingredients were mixed and a candle was made as described in EXAMPLE 1. The candle was burned with the following results:

| | |
|---|---|
| Burn rate | 0.183 cm/s |
| Smoke volume | Excellent |
| Smoke color | Dark reddish brown |
| Flame color | Bright yellowish-white |

EXAMPLE 3

| | Percent |
|---|---|
| Bismuth | 30 |
| Ammonium Iodate | 65 |
| Diatomaceous earth | 5 |

The ingredients were mixed and a candle was made as described in EXAMPLE 1. The candle was burned with the following results:

| | |
|---|---|
| Burn rate | 0.139 cm/s |
| Smoke volume | Poor |
| Smoke color | Brick red |
| Flame color | Bright yellowish-white |

EXAMPLE 4

| | Percent |
|---|---|
| Bismuth | 30 |
| Magnesium | 5 |
| Ammonium Iodate | 60 |
| Diatomaceous earth | 5 |

The ingredients were mixed and a candle was made as described in EXAMPLE 1. The candle was burned with the following results:

| | |
|---|---|
| Burn rate | 0.133 cm/s |
| Smoke volume | Good |
| Smoke color | Light purple |
| Flame color | Yellowish-orange |

EXAMPLE 5

| | Percent |
|---|---|
| Molybdenum | 20 |
| Ammonium Iodate | 35 |
| Iodoform | 45 |

The ingredients were mixed and a candle was made as described in EXAMPLE 1. The candle was burned with the following results:

| | |
|---|---|
| Burn rate | 0.212 cm/s |
| Smoke volume | Excellent |
| Smoke color | Reddish purple |
| Flame color | Yellowish-orange |

EXAMPLE 6

| | |
|---|---|
| Molybdenum | 20 |
| Ammonium Iodate | 30 |
| Iodoform | 45 |
| Diatomaceous earth | 5 |

The ingredients were mixed and a candle was made as described in EXAMPLE 1. The candle was burned with the following results:

| | |
|---|---|
| Burn rate | 0.226 cm/s |
| Smoke volume | Good |
| Smoke color | Reddish-purple |
| Flame color | Yellowish-orange |

In the above examples, except for EXAMPLE 3, the smoke volumes which were obtained were very good and comparable to the volume of smoke produced by burning a standard organic dye formulation .

In the bismuth fuel group, the smoke colors were generally brown to reddish brown and when iodoform was reduced or removed, the color became more red but the burning rate and the smoke volume decreased. The flames produced by the bismuth-fueled group were white in color and very intense. In EXAMPLE 4 above, a small percentage of magnesium was added and the smoke volume increased significantly and the smoke color changed drastically form the brick red of EXAMPLE 3 to a very light purple color. The burning rate did not change significantly when magnesium was added.

It can thus be seen that the present invention provides improved compositions for producing red smoke and bright flames which will have use in both day and night operations.

Obviously many modifications and variations of the present invention was possible in the light of the above teachings. It is therefore to be understood that the invention may be practiced otherwise than as specifically described.

I claim:

1. A pyrotechnic composition for simultaneously producing red smoke and bright flame comprised, by weight, of between 25 and 65 percent of ammonium iodate;

between 30 and 45 percent of iodoform, between 0 and 5 percent of diatomaceous earth, and the balance of a fuel selected from a group consisting of bismuth, molybdenum, and a mixture of bismuth and magnesium.

2. A pyrotechnic composition for simultaneously producing red smoke and bright flame as set forth in claim 1 wherein said composition is comprised of between 30 and 40 percent of bismuth.

3. A pyrotechnic composition for simultaneously producing red smoke and bright flame as set forth in claim 1 wherein said composition is comprised of about 20 percent of molybdenum.

4. A pyrotechnic composition for simultaneously producing red smoke and bright flame as set forth in claim 1 wherein said composition is comprised of about 5 percent of magnesium and about 30 percent of bismuth.

5. A pyrotechnic composition for simultaneously producing red smoke and bright flame as set forth in claim 1 having about 5 percent of diatomaceous earth.

6. A pyrotechnic composition for simultaneously producing red smoke and bright flame as set forth in claim 1 having about 40 percent of bismuth, about 35 percent of iodoform and about 25 percent of ammonium iodate.

7. A pyrotechnic composition for simultaneously producing red smoke and bright flame as set forth in claim 1 having about 60 percent of ammonium iodate, about 30 pecent of bismuth, about 5 percent of magnesium and about 5 percent of diatomaceous earth.

8. A pyrotechnic composition for simultaneously producing red smoke and bright flame as set forth in claim 1 having about 45 percent of iodoform, about 35 percent of ammonium iodate and about 20 percent of molybdenum.

* * * * *